United States Patent [19]

Hotta

[11] 4,319,629

[45] Mar. 16, 1982

[54] CONSTANT TEMPERATURE BOX

[75] Inventor: Masashi Hotta, Osaka, Japan

[73] Assignee: Shimano Industrial Company Limited, Osaka, Japan

[21] Appl. No.: 226,094

[22] Filed: Jan. 19, 1981

Related U.S. Application Data

[62] Division of Ser. No. 32,868, Apr. 24, 1979, abandoned.

[30] Foreign Application Priority Data

Apr. 29, 1978 [JP] Japan ..... 53-57979

[51] Int. Cl.[3] ..... F25D 3/08; F24H 7/00; A47G 23/04

[52] U.S. Cl. ..... 165/47; 62/457; 126/400

[58] Field of Search ..... 165/47; 62/457; 126/246, 400

[56] References Cited

U.S. PATENT DOCUMENTS 2,496,296 2/1950 Lobl ..... 62/457 X 3,262,283 7/1966 Taylor ..... 62/457 X

*Primary Examiner*—Albert W. Davis

*Attorney, Agent, or Firm*—Stevens, Davis, Miller & Mosher

[57] ABSTRACT

A constant temperature box comprises a body and a lid therefor which are of adiabatic construction, and is incorporated with a container used as a cooling or heating source, the container being made flat and arranged opposite to each other at the side walls of the box body, so that the container may cool or warm foodstuffs and beverages kept within the constant temperature box.

4 Claims, 4 Drawing Figures

CONSTANT TEMPERATURE BOX

Figure 1:
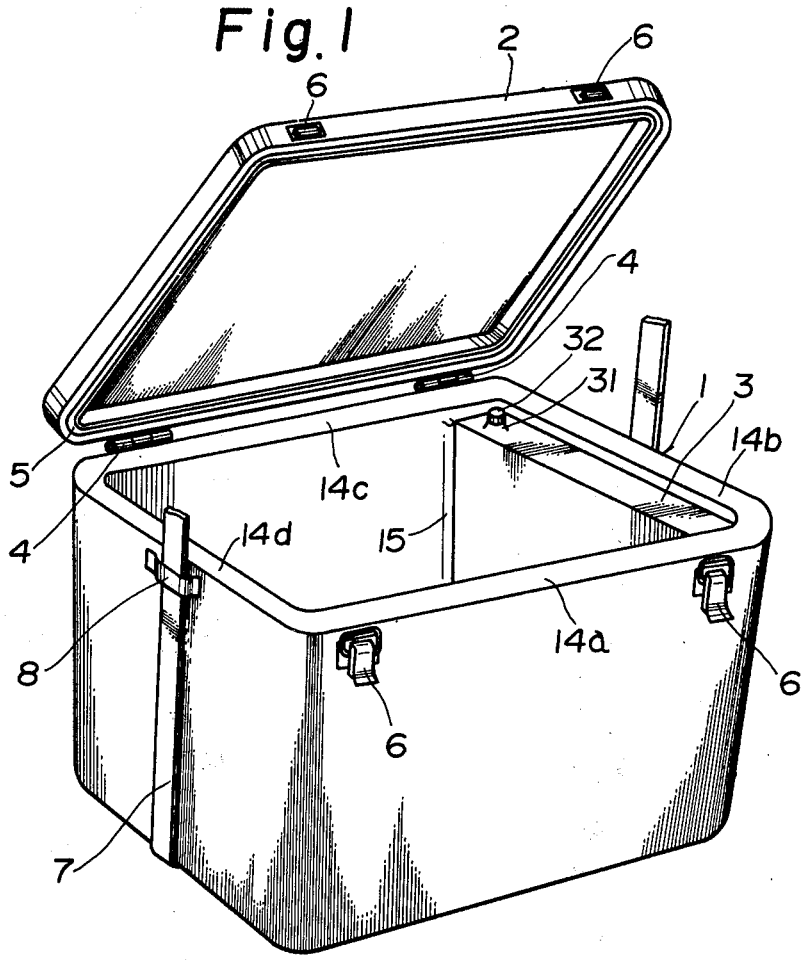

This is a division of application Ser. No. 32,868 filed Apr. 24, 1979, now abandoned.

This invention relates to a constant temperature box, and more particularly to a portable constant temperature box which keeps its interior at constant temperature by means of a cooling or heating source, so that cold foodstuffs and beverages, such as fruits, canned beer or fish, can be kept cold within the box and warm foodstuffs such as lunches or tea, can be kept warm.

Generally a cooler or ice-box for preserving cold to cool foodstuffs and beverages kept therein is known as a constant temperature box, such as a thermal jar, of adiabatic construction having two thin walls of glass with a vacuum therebetween, for keeping the contents cold or warm.

The cooler comprises a body and a lid of insulating material, such as polyurethane. The lid closes tight against the body, thereby forming an adiabatic. The cooler is usually charged with ice together with foodstuffs and beverages so that the ice, as a cooling source, may keep the foodstuffs and beverages cold.

Of course, the ice within the cooler eventually melts to collect at the bottom of the cooler and undesirably interacts with the cooler contents. This interaction is particularly undesirable when the cooler contains fish as the latter readily discolor or deteriorate when in contact with water.

The constant temperature box has a higher adiabitic effect than the cooler, so that foodstuffs and beverages within the box are kept cold or warm for a long period. The box, however, is complex in construction and expensive to produce because a large-sized box is required to accomodate a large amount of foodstuffs and beverages. Moreover, the glass walls of the constant temperature box are breakable.

The present invention has been designed to overcome these problems. Thus, an object of the invention is to provide a constant temperature box which is, on the one hand, simple in construction; inexpensive to produce and unbreakable even with rough handling, and, on the other hand capable of positively preserving the cold or heat therein without affecting the quality of foodstuffs and beverages, thereby keeping them at constant temperature for a long period.

The invention incorporates a liquid container of a cooling or heating source within a constant temperature box comprising a body having an upper opening and a lid closing tight the upper opening, which are both of adiabatic construction. The container is made flat and arranged to abut against the side walls of the box body, to cool or warm the foodstuffs and beverages kept within the box.

The cooling or heating source container is hollow and hermetically sealed and is filled with a liquid which serves as the cooling or heating source. The container is nearly equal in width to an interval between two opposite side walls of the body, nearly equal in height to the body and small in thickness, thus being flat as a whole. The cooling or heating source container also has an intake for liquid and a stopper closing the intake.

The cooling or heating source container is formed of a heat-resistant, heat transferrable material, such as synthetic resin or aluminum alloy.

The liquid within the container is generally water. The container can be filled with water and closed by the stopper and then put into a refrigerator to freeze the water for subsequent use as a cooling source. On the other hand, the container can be filled with water preheated to a high temperature for use as the heating source.

The cooling or heating source container constructed as described is fit into the box body upright to abut against side walls thereof so that cold or warm air may be derived from the cooling or heating source and circulated by convection within the box to cool or warm foodstuffs and beverages wholly by convection and by conduction from direct contact with the container, thus collectively improving the cooling or heating effect.

Figure 2:
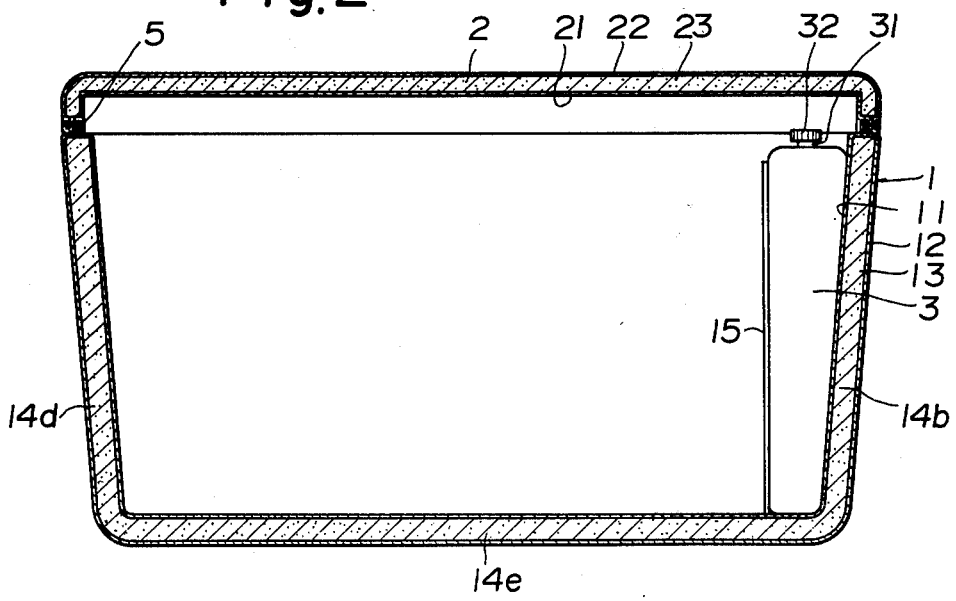
Figure 3:
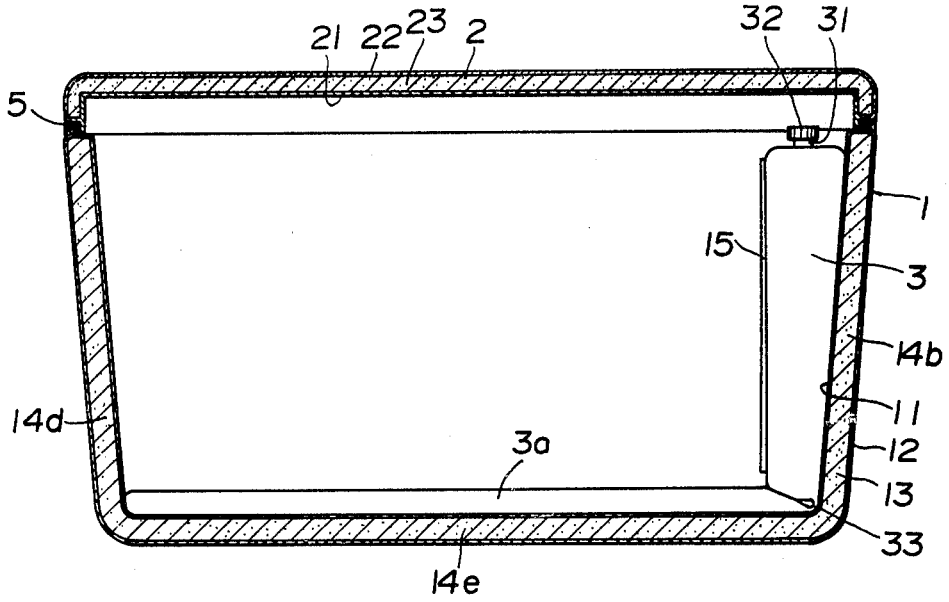
Figure 4:
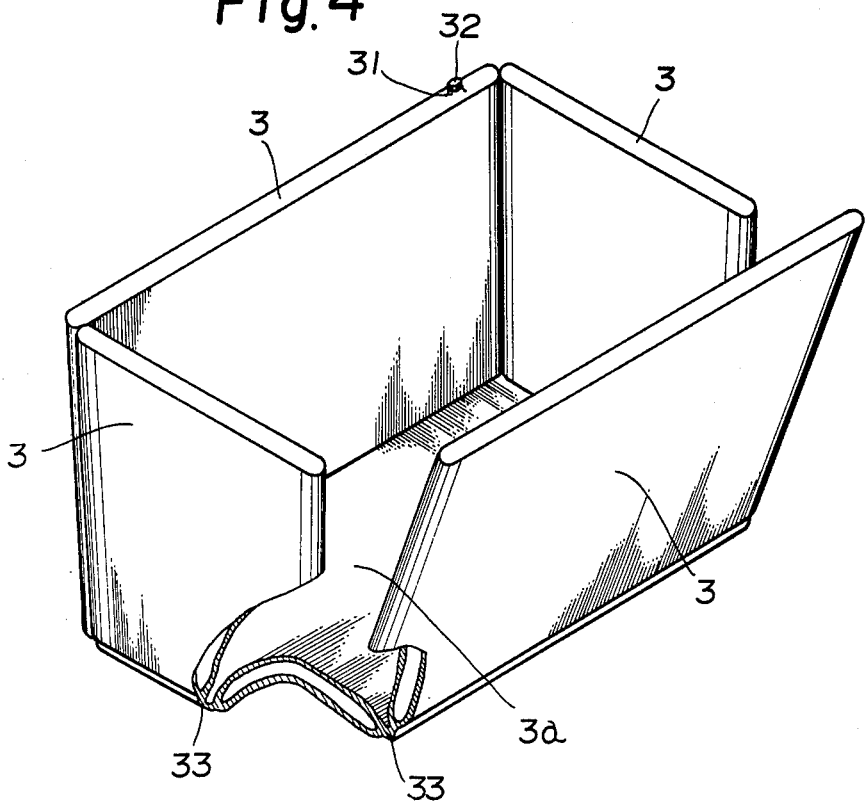

These and other objects and novel features of the invention will be more apparent from the following detailed description taken in accordance with the accompanying drawings, in which FIG. 1 is a perspective view of a constant temperature box of an embodiment of the invention with its lid open, FIG. 2 is a longitudinally sectional view of the constant temperature box with its lid closed, FIG. 3 is a longitudinally sectional view of a modified embodiment of the invention, and FIG. 4 is a perspective view of another modified embodiment showing a cooling or heating source container.

A constant temperature box of the invention, as shown in FIG. 1, comprises an upwardly opening body 1 having therein a space for containing foodstuffs and beverages, a lid 2 closing the upper opening of the body 1, and a cooling or heating source container 3 incorporated within the box body 1.

The box body 1, as shown in FIG. 2, comprises an inner body 11 of stainless steel, an outer body 12 of synthetic resin, and insulating material 13, such as polyurethane or foaming sterol resin, inserted between the inner and outer bodies 11 and 12. The body 1 is formed of four opposite side walls 14*a* to 14*d* and a bottom 14*e* and opens upwardly.

The lid 2 is of a shallow dish-like shape and comprises an inner and outer bodies 21 and 22 of synthetic resin and insulating material 23 inserted therebetween. The lid 2 is connected with the upper edge of one side wall 14*c* by hinges 4 to permit opening and closing of the box and is surrounded at the lower edge with packing 5 to contact with the upper edge of body 1 for tightly closing the interior of the box.

Between the lid 2 and the body 1 are provided clasps 6 for tightly holding them together, and at the body 1 is provided band holders 8 through which a band 7 is inserted for the convenience of carrying the constant temperature box.

The cooling or heating source container 3 comprises a hollow hermetically sealed box, which is chargeable with liquid, the liquid serves as the cooling or heating source. The container 3, as shown in FIGS. 1 and 2, is about equal in width to an interval between opposite side walls 14*a* and 14*c*, nearly equal in height to the box body 1 and small in thickness and takes a generally wall like shape. At the upper wall of container 3 are provided an intake 31 for the liquid and a stopper 32 for closing the intake 31. The cooling or heating source container 3 is formed of a heat resistant synthetic resin and/or aluminum alloy which is capable of transferring heat or cold to the box interior.

When used as a cooling source, the container 3 is filled with water through the intake 31, and the water is frozen by, for example, a domestic refrigerator. When used as a heating source, the container 3 is similarly charged with hot water preheated to a high temperature.

The cooling or heating source container 3 is fit into the constant temperature box opposite sidewalls 14*c* and 14*d* and is supported upright by supporting means hereinafter described.

The supporting means comprises a pair of strip projections provided at the inner surfaces of a pair of opposite side walls 14*a* and 14*c* and extending vertically thereof. The strip projections 15 as shown in FIGS. 1 and 2, are each positioned at the walls 14*a* and 14*c* close to the side wall 14*b* whereby the strips 15 and the side wall 14*b* support the container 3 upright, with the container abutting against the inner surface of wall 14*b*.

In addition, the supporting means may comprise two pairs of projections 15 which are so arranged that each pair is spaced at an interval coincident with thickness of the container 3 so that the container 3 may be inserted just between the projections 15. In this instance, the container 3 is width-wise supported at the intermediate portions of side walls 14*a* and 14*c*.

The strip projections 15 also may be provided at the side walls 14*b* and 14*d* in place of those 14*a* and 14*c*, in which case the container 3 is formed in a size coincident with that of the wall 14*a* or 14*c*.

The constant temperature box of the invention constituted as aforegoing, is used in such a manner that the cooling or heating source container 3 is previously charged with water and put into a freezer to thereby freeze the water, or charged with hot water, and then the container 3 is placed in the box body 1 and supported by the supporting means. Hence, the interior of body is kept cold or warm by air cooled or heated by the cooling or heating source and circulating by convection in the box, thereby keeping the box contents at a low or high temperature. In other words, the cooling or heating source container 3, which is inserted upright within the body 1 of constant temperature box, allows cold or warm air to circulate by convection within the box, the cold air flowing downwardly from the upper portion of container 3 and the warm air upwardly from the lower portion thereof. Hence, the constant temperature box is filled with the cold or warm air throughly and uniformly, thereby keeping cold or warm the whole box interior. In addition, the contents may directly contact with the container 3. As a result, the box contents are effectively and rapidly cooled or warmed by the air circulating by convection, and by conduction from direct conduct with the container 3.

As an alternative to the above embodiment employing a single cooling or heating source container, two or more such containers may be disposed along the opposite side walls 14*b* and 14*d* respectively, or along the side wall 14*b* and bottom 14*e* as shown in FIG. 3. As seen from FIG. 3, a first cooling or heating source container 3 and a second such container 3*a* abut against the side wall 14*b* and bottom 14*e* respectively and are connected to be foldable.

When the containers 3 and 3*a* are formed of a synthetic resin the foldable connection is formed by hinged portions 33, and when the containers 3 and 3*a* are formed of an aluminum alloy or the like the foldable connection is formed by hinges or flexible connectors.

As another alternative, four of the first cooling or heating source containers 3, 3, 3, 3 may be inserted along the four side walls 14*a* to 14*d* and combined with the second cooling and heating source container 3*a* laid along the bottom 14*e*.

In this instance, the first and second cooling and heating source containers 3 and 3*a* may be connected in a box-like shape, but it is preferable that each of the first containers 3 be separated from one another and foldably connected to the second container 3*a*.

In addition, the containers 3 through 3*a* are, as shown in FIG. 3, fluid connected through hinged portions 33 and communicate with each other therethrough, whereby a single intake 31 attached to one container 3 as shown in FIG. 4 is sufficient to fill all containers.

As clearly understood from the above description, the constant temperature box of the invention is constructed such that the cooling or heating source container is charged with a liquid mainly with water, the water being frozen for use as a cooling source or heated for use as a heating source. The container is placed into the box body and held along the inner surface of at least one side wall to thereby cool or warm the box contents by cold or warm air from the container. As a result, the container selectively and positively keeps the interior cold or warm. Hence, when the constant temperature box is used as the cooler there is no discoloration or degeneration of the contents, while, the interior of the box is as a whole kept cold by circulation of cold air and also the contents are kept cold by direct contact with the cooling source. In other words, the convection of cold air and conduction of the cold by direct contact of the contents with the cooling source, keep the contents cold, thereby highly improving the cooling effect. The box, when used for warning, has similar high heating effect. Furthermore, the supporting means supports the container to opposite side walls of the body, so that the container can be used to partition the interior of body to improve the cooling or heating effect. Also, the constant temperature box is very simple in construction and inexpensive so as to be of practical use.

While specific exemplary embodiments of the invention have been shown and described, the invention is not to be considered as limited thereto as numerous modifications can be made. Accordingly, the invention is to be considered as limited solely by the following claims.

What is claimed is:

1. A portable constant temperature box for keeping inserted objects cold or warm comprising:

(a) a body defining an inner space for receiving said objects, said body comprising side walls and a bottom wall each having an adiabatic construction, said body having an upwardly directed opening;

(b) a lid of adiabatic construction pivoted to the upper portion of one of said side walls to open and close said upper opening of said body;

(c) means for tightly securing said lid to said body;

(d) a cooling or heating source holder housed within said body, said cooling or heating source holder being hollow and hermetically sealed for holding liquid which serves as a cooling or heating source, said holder comprising a first cooling or heating source container which abuts against one of said sidewalls of said box body and a second cooling or heating source container which abuts against the bottom of said box body, said first and second cooling or heating source containers being fluid connected together and being foldable at their interconnection, said first cooling or heating source container having a width substantially equal to an interval existing between opposite side walls of said body and a height substantially equal to the height of a side wall of said body, said cooling or heating source holder having a small thickness as compared with the inner space of said body and a flat-wall-like shape as a whole and, at one end face, an intake for said liquid and a stopper for closing said intake; and, (e) support means for supporting said first cooling or heating source container upright and between opposite side walls within said body.

2. A constant temperature box according to claim 1, wherein said box body comprises four side walls and one bottom wall and said cooling or heating source holder comprises four first cooling or heating source containers each of which abuts against a respective one of said four side walls of said body and a second cooling or heating source container which abuts against said bottom wall, said first cooling or heating source containers each being foldably connected to said second cooling or heating source container.

3. A constant temperature box according to claim 2, wherein said first cooling or heating source containers are fluid connected together and to said second cooling or heating source container and a single intake and associated stopper is provided at one of said containers.

4. A constant temperature box as in claim 2, wherein each said first container abuts substantially the entire area of one of said sidewalls and said second container abuts substantially the entire area of the bottom of said box body.

* * * * *